US010542803B2

(12) United States Patent
Roberts et al.

(10) Patent No.: US 10,542,803 B2
(45) Date of Patent: Jan. 28, 2020

(54) CASE FOR A MOBILE DEVICE

(71) Applicant: Tech 21 Licensing Limited, Twickenham (GB)

(72) Inventors: Jason Roberts, Twickenham (GB); Benjamin Thorpe, Uxbridge (GB); Jeremy David McManus, London (GB)

(73) Assignee: TECH 21 LICENSING LIMITED, Twickenham (GB)

( * ) Notice: Subject to any disclaimer, the term of this patent is extended or adjusted under 35 U.S.C. 154(b) by 0 days.

(21) Appl. No.: 15/661,762

(22) Filed: Jul. 27, 2017

(65) Prior Publication Data

US 2018/0027938 A1 Feb. 1, 2018

(30) Foreign Application Priority Data

Jul. 27, 2016 (GB) ..... 1612967.8

(51) Int. Cl.
*A45C 11/00* (2006.01)
*A45F 5/00* (2006.01)

(52) U.S. Cl.
CPC ..... *A45C 11/00* (2013.01); *A45F 5/00* (2013.01); *A45C 2011/002* (2013.01); *A45C 2011/003* (2013.01)

(58) Field of Classification Search
USPC ..... 206/320, 576
See application file for complete search history.

(56) References Cited

U.S. PATENT DOCUMENTS

| | | | | |
|---|---|---|---|---|
| 8,624,111 | B2 | 1/2014 | Tages et al. | |
| 2012/0031788 | A1* | 2/2012 | Mongan | A45C 11/00 206/320 |
| 2013/0146491 | A1* | 6/2013 | Ghali | G06F 1/1626 206/320 |
| 2013/0240381 | A1* | 9/2013 | Hsu | G06F 1/1626 206/45.2 |
| 2015/0068934 | A1* | 3/2015 | Armstrong | A45C 11/00 206/320 |
| 2015/0068935 | A1 | 3/2015 | Kay et al. | |
| 2017/0027294 | A1 | 2/2017 | Roberts et al. | |
| 2017/0187853 | A1 | 6/2017 | Dukerschein et al. | |

OTHER PUBLICATIONS

European Search Report for GB 1612967.8, completed Nov. 24, 2016.
European Search Report for GB 17183124.1, completed Dec. 19, 2017.

* cited by examiner

*Primary Examiner* — Jacob K Ackun
(74) *Attorney, Agent, or Firm* — Stephen J. Weyer, Esq.; Stites & Harbison, PLLC

(57) ABSTRACT

A case for a mobile device with a screen. The case comprises a band arranged to surround the edge of the device. The band comprises an outer layer of a flexible polymer, an inner layer of damping material and an intermediate layer of a dissipation material between the inner and outer layers. The intermediate layer is the hardest of three layers and the inner layer is the softest.

21 Claims, 3 Drawing Sheets

CASE FOR A MOBILE DEVICE

FIELD OF THE INVENTION

The present invention relates to a case for a mobile device with a screen.

BACKGROUND OF THE INVENTION

Mobile device cases are now widely used following the explosion in use of smart phone and tablet devices. The applicant is currently producing a case which is described in WO 2015/101771. The case has an outer material of TPU which has a Shore Durometer hardness between 90A to 95A and an inner impact absorbing and damping material which is sold under the trade name Flexshock®. The impact absorbing material may, for example, be TPE, viscoelastic TPE, Poron or soft TPU and should preferably have a Shore Durometer hardness between 30A and 60A.

Such a case is highly successful commercially as the two-layered structure is aesthetically pleasing and provides good impact protection.

WO 2015/101771 contemplates a case in which a rigid polymer is used as an outer layer creating a three-layer structure. Other cases also use such a hard outer layer. The advantage of a hard outer layer is that it disperses the impact. The softer inner layer can then absorb this dispersed impact. However, an outer layer is prone to scratches and cracks. The hard outer material does not generally absorb energy and is generally provided just to provide a structural surface for the case.

Other cases are known such as the Otterbox Defender with an outer soft material and an inner hard material. The inner hard material frames the device and provides a rigid shell for the case while the outer softer material provides absorption of impact energy. However, any impact energy which passes through the soft material and reaches the hard material is transmitted to the device. The hard inner material may also scratch the device.

Obviously impact protection can be enhanced by increasing the thickness of at least one of the layers. However, thin and lightweight cases are far more desirable as they are more aesthetically pleasing, more convenient for a user to carry and have less negative effect on the radiofrequency performance of the device.

SUMMARY OF THE INVENTION

The present invention, in one form, relates to a case for a mobile device with a screen. The case comprises a band arranged to surround the edge of the device. The band comprises an outer layer of a flexible polymer, an inner layer of damping material and an intermediate layer of a dissipation material between the inner and outer layers, wherein the intermediate layer is the hardest of three layers and the inner layer is the softest.

This arrangement of three layers places the hardest dissipation layer between a soft inner layer of damping material and an outer layer of flexible polymer with an intermediate hardness. Upon impact, the outer layer with its intermediate hardness will absorb and disperse some of the impact. On reaching the dissipation material, the impact is spread across a wide portion of the band thereby reducing the localised force to be absorbed by the damping material.

High speed photography has shown that such a three layer structure provides significantly enhanced impact protection as compared to the two layer band referred to in WO 2015/101771 for bands which have the same overall thickness. Further, the fact that the hard material is an intermediate layer means that it is protected from scratching and cracking, while the inner layer provides cushioning for the device itself ensuring that it does not get scratched when the device is inserted into and removed from the case.

For optimum performance, the dissipation material is preferably thinner than at least one of the other layers and preferably both of the other layers for a substantial portion of the circumference of the band. As the dissipation material is a relatively hard layer, it can be made thin to effectively represent a "shell" which will adequately dissipate the impact forces without unduly increasing the thickness or mass of the case.

The dissipation material is preferably fully enclosed by the other two layers for a substantial portion of the band. This protects the harder material from being scratched or cracked and also reduces the possibility of the device being scratched by the harder material. However, the dissipation material may form the inner face of the band at at least some of the regions of the band where ports and/or switches are formed. This allows the case to have greater rigidity in these regions thereby ensuring a better engagement between the case and the underlying ports and/or switches.

In some regions, the flexible polymer may form the inner face of the band at at least some of the region of the band where ports and/or switches are formed. For example, the current designs of iPhone have a port for a headphone jack, a port for a lightning connector and a speaker in the bottom edge of the phone. Cases in this region are therefore required to have more open regions than other regions surrounded by the band and it is therefore awkward and unnecessary to provide more than one material in this region.

Preferably, the dissipation material has a Shore Durometer hardness of 60 D to 100 D, preferably 70 D to 90 D and more preferably 80 D to 90 D.

The dissipation material preferably has outwardly projecting ribs. These serve to generate a localised increase in thickness in the hard layer to increase its rigidity without unduly increasing the mass or thickness. Further, they provide a good bonding surface between the intermediate layer and outer layer. Similarly, the dissipation material may have inwardly projecting ribs. If so, there are preferably more outwardly projecting ribs than inwardly projecting ribs. These inwardly projecting ribs are primarily provided to provide a good bonding surface to the damping material but have a less significant effect on the rigidity of the dissipation layer.

Preferably the damping material has inwardly projecting ribs. This enhances the impact absorbing ability of the inner layer. Preferably the damping material extends along a substantial portion of the circumference of the band including any corners. These are the regions most vulnerable to impact as however a device is dropped, the most likely first point of impact is on one of the corners. Further, it is generally beneficial to have the damping material extending along any sides of the device away from regions of the band where ports and/or switches are formed.

The damping material is preferably present in a number of discreet portions. By contrast, the flexible polymer and dissipation material are each a single continuous piece.

Preferably the damping material has a Shore Durometer hardness of 35A to 80A and preferably 45A to 55A.

The case may simply be a band which surrounds the four edges of the device, often referred to as a four sided case. However, preferably, the case has a back and the band forms a wall extending away from the back. This is commonly referred to as a five sided case. In this case, the back is preferably made substantially of the flexible polymer and is continuous with the outer layer. It is possible that one of the other layers, particularly the layer of damping material may extend to a limited extent across the back.

Preferably the flexible polymer has a Shore Durometer from 80A to 100A, preferably 90A to 100A and more preferably 90A to 96A.

Preferably the band has an upper lip surrounding the screen, in use, the lip being formed only of the flexible polymer in the outer layer. This provides an edge with a neat appearance.

Additional features such as inserts for lens regions of the camera and the like, may be included. However, preferably, the entire band or case is made from just the three materials forming the three layers. There may be air gaps provided in the corners to provide an air cushioning effect. However, preferably there are no air gaps between the three layers as the three-layer structure provides adequate damping without requiring additional air cushioning.

BRIEF DESCRIPTION OF THE DRAWINGS

An example of a case in accordance with the present invention will now be described with reference to the accompanying drawings, in which.

DETAILED DESCRIPTION

Figure 4:
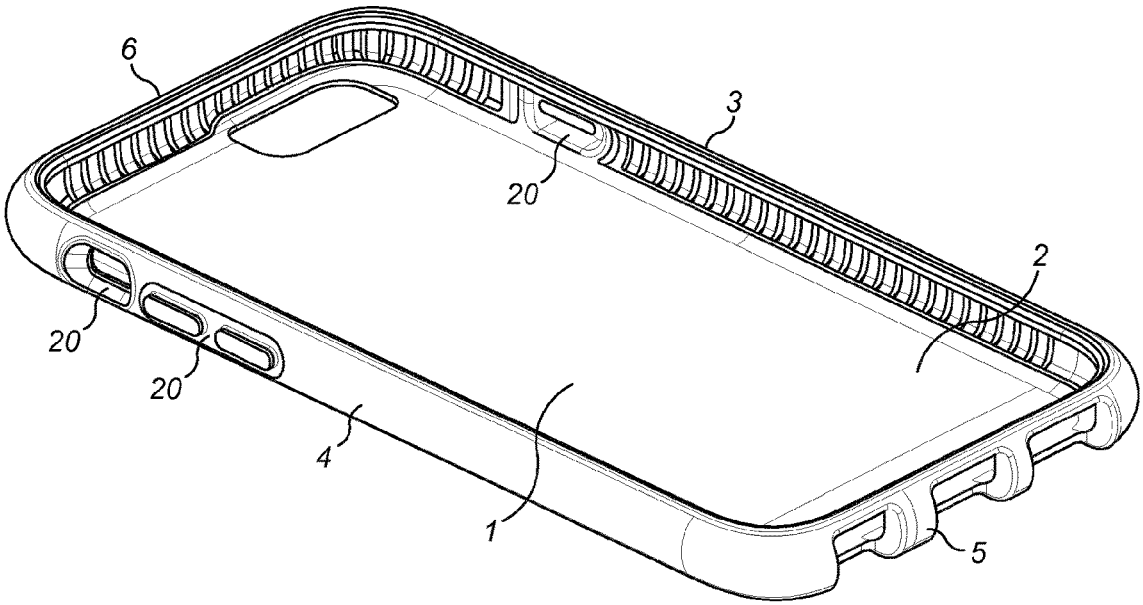
FIG. 4 is a similar perspective view to FIGS. 2 and 3 showing the finished case.

The case 1 shown in full in FIG. 4 has a back 2, two side walls 3, 4, a bottom wall 5 and a top wall 6.

The illustrated case is for an iPhone 6S, but the principles apply to cases for all smart phone and tablet devices as well as e-readers and the like.

Figure 1:
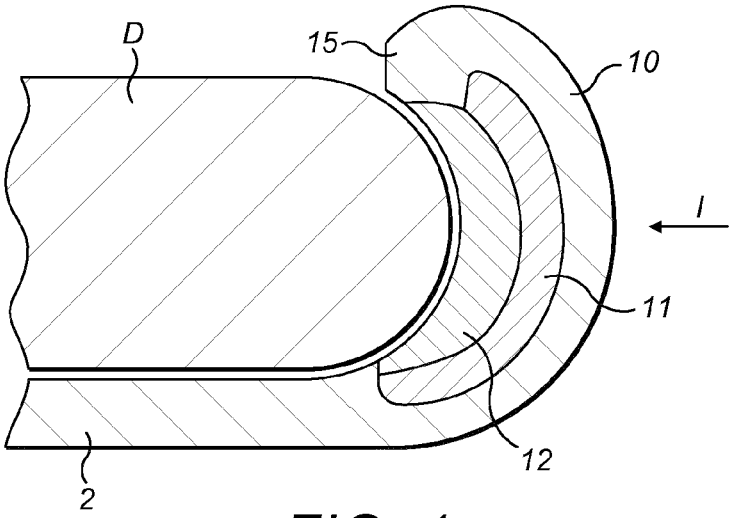
FIG. 1 is a lateral cross-section through a band and the back of the case and includes a portion of the device in situ.
Figure 5:
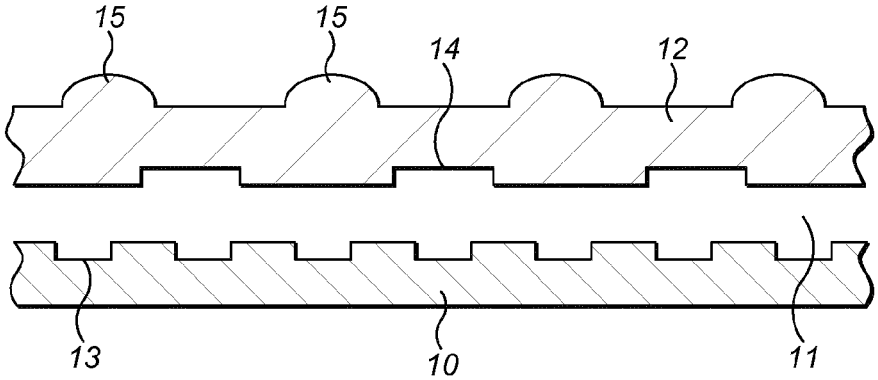
FIG. 5 is a schematic cross-section along the length of the band in a plane parallel to the back showing the three layer structure.

The back 2 is optional as the principles described here apply equally to a backless band which surrounds the edges of the device. The three layer structure forming the majority of the side wall structure is shown in FIGS. 1 and 5. This comprises an outer layer 10 of flexible polymer, an intermediate layer 11 of dissipation material and an inner layer 12 of damping material.

The outer layer 10 of flexible polymer may be TPU, TPE or silicone. If the back 2 is present, this material will form the majority of the back, although other materials may extend to a small extent across the back.

The dissipation layer 11 may be PC, ABS, PC/ABS blends, Hard TPU grades, glass and fibre-filled rigid thermoplastics, nylon, glass and fibre-filled nylons and similar materials. As shown in FIG. 5, the intermediate layer is provided with a plurality of outwardly extending ribs 13 which are embedded within the outer layer 10 with no air gaps. These ribs increase the rigidity and strength of the intermediate layer and form an effective increase in the thickness of the hard layer without unduly increasing the weight. The intermediate layer 11 also has a number of inwardly projecting ribs 14. There are fewer of these than a number of outwardly projecting ribs 13 and these are provided in order to provide an improved bond with the inner layer 12.

The inner layer 12 may be a soft elastomer, soft TPU, TPE, silicone, foam or the like. The inner layer 12 has a number of inwardly projecting ribs 15 which are configured to contact the device D such that there is generally no contact between the device and the case in the regions where the damping material is present other than through the ribs.

The overall thickness of the band is intended to be compatible with our existing cases as described in WO 2015/101771. Thus, each layer should be between 0.5 mm and 0.85 mm and is preferably no thicker than 2 mm. These thicknesses apply to the general thickness of the band away from any ribs or other features.

As will be apparent from FIG. 1, the intermediate layer 11 is fully surrounded by the outer layer 10 and inner layer 12 such that the material is protected from scratching and cracking. The outer layer 10 extends to a lip 15 which surrounds the edge of the device D. In the lip region 15, the intermediate 11 and inner 12 layers are absent. This preserves a clean appearance to the case as only one material is visible in this region.

Any impact I on the band is initially dampened and partially absorbed by the outer layer 10. Because the outer layer 10 is not particularly hard, it is not vulnerable to cracking. The energy not absorbed in the outer layer 10 is then dissipated over a wide area by the intermediate layer 11 which spreads the impact such that the requirements of the absorbing material in the inner layer 12 are reduced. The damping material 12 absorbs much of the remaining energy. In doing so, it is assisted by the presence of the ribs 15.

The above described structure describes the band for the majority of the circumference of the case. This structure is preferred where there are no features on the case to be accommodated. In particular, this structure should be present in the four corners of the device as these are most vulnerable to impact.

Figure 3:
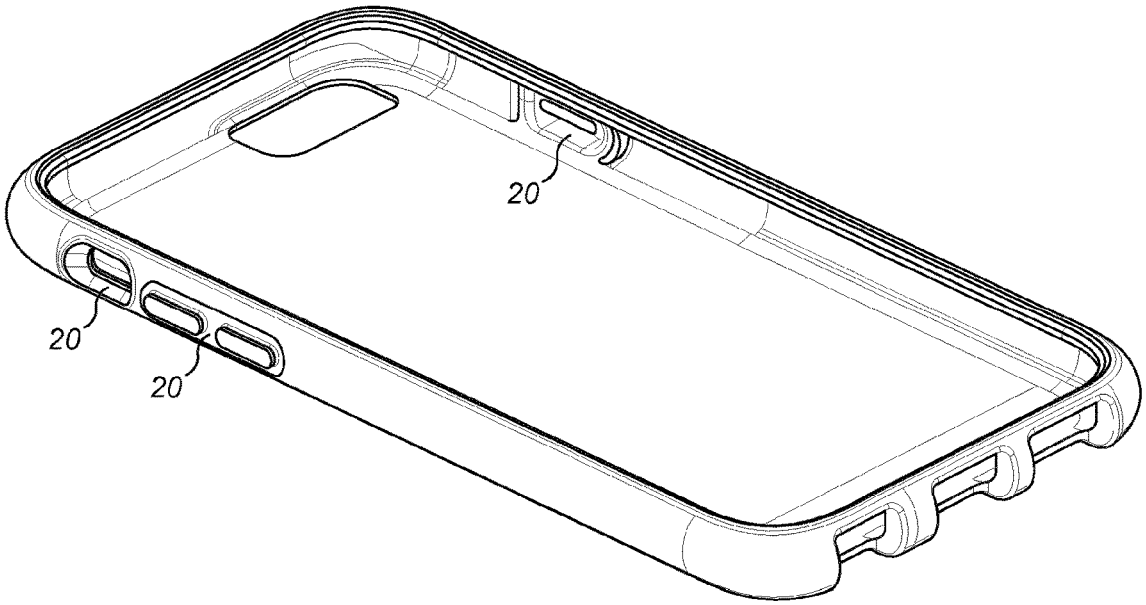
FIG. 3 is a similar perspective view to FIG. 2 also showing the outer layer of flexible polymer.

However, in the vicinity of any switches and ports as designated by reference numeral 20 in FIG. 3 and FIG. 4 the cross-sectional structure of the case is different in that the inner layer 12 of damping material is absent. In this region, the intermediate layer forms the innermost layer such that there is a relatively hard material in contact with these parts of the device. This helps to maintain the stability of the case in these regions to allow more reliable manipulation of the underlying buttons.

Also, in the case of the iPhone as in many other smart phones, the lower side 5 is required to have three large ports to accommodate the speaker, lightning connector and headphone jack socket. In this region, only the outer layer of flexible polymer is present. However, the three layer structure is preserved in the corners.

There are a number of ways in which the case can be manufactured.

1. Insert Injection Over-Moulding

Figure 2:
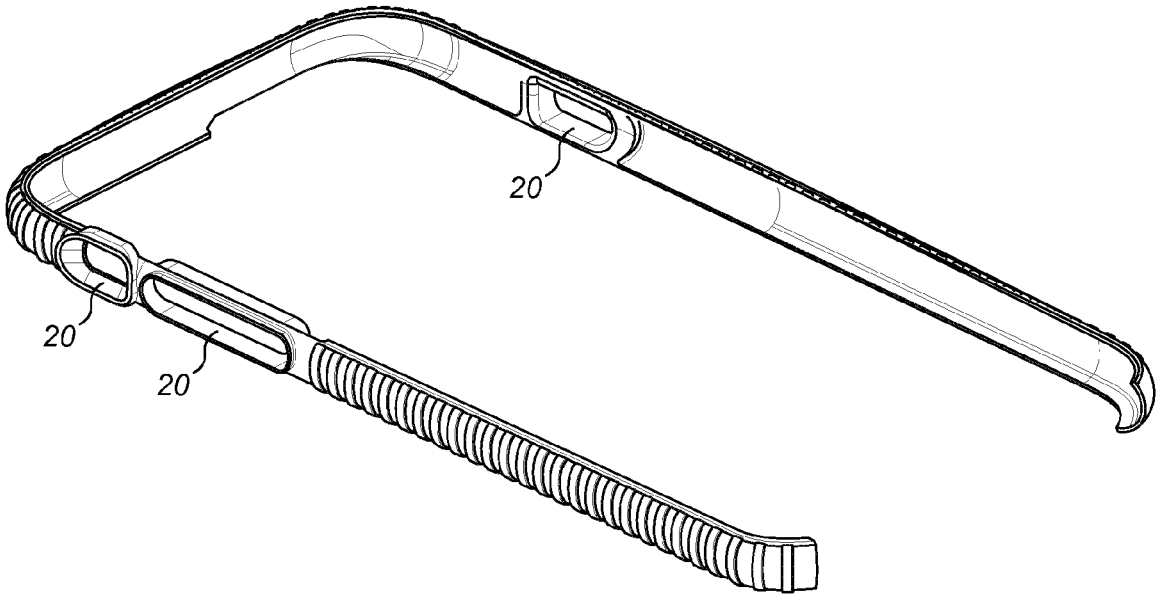
FIG. 2 is a perspective view of the layer of dissipation material.

This is a manual loading process. The intermediate layer 11 can first be injection moulded as shown in FIG. 2. This component is then attached to a mould core part and inserted into a second injection mould where the outer layer 10 is over-moulded to form the sub-assembly shown in FIG. 3. This can either be done using a mechanical collapsible core, or the sub-assembly can be used demoulded by hand. This sub-assembly is then put into another core and inserted into a mould to over-mould the inner layer 12.

Alternatively, the intermediate layer 11 is not removed from the first stage core. Once the intermediate layer 11 is moulded, without being removed from its core, it is inserted into the second mould to over-mould the outer layer 10.

2. Multi-Shot Injection Moulding with Insert Over-Moulding

This method is a semi-automated method with the intermediate layer 11 and outer layer 10 moulded in a two-shot injection moulding process with the intermediate layer 11 being the first shot and the outer layer 10 being the second. A mechanical collapsible core can be used where the sub-assembly can be removed by hand. A sub-assembly will then be put into another core and inserted into a mould to over-mould the inner layer 12.

3. Multi-Shot Injection Moulding

This is a fully automated process with two operational methods.

Firstly, the intermediate layer 11 and outer layer 10 are moulded in a three-shot injection moulded process with the intermediate layer 11 being the first shot and the outer layer 10 being the second. A mechanical collapsible core retracts and a robotic/computer controlled arm picks up the sub-assembly and transfers the moulded component to a second injection moulding machine where the sub-assembly is inserted into another collapsible core to over-mould the inner layer 12. This method is fully automated but requires a more complex machine to injection mould material in a three stage process.

The invention claimed is:

1. A case for a mobile device with a screen, the case comprising a band arranged to surround the edge of the device, the band comprising an outer layer of a flexible polymer, an inner layer of damping material and an intermediate layer of a dissipation material between the inner and outer layers, wherein the intermediate layer is the hardest of three layers and the inner layer is the softest; and wherein, in a lateral cross-sectional plane through the band, the dissipation material is fully enclosed by the two layers for a substantial portion of the band.

2. The case according to any claim 1, wherein the dissipation material forms the inner face of the band at at least some of the regions of the band for accommodating ports and/or switches of the mobile device.

3. The case according to claim 1, wherein the flexible polymer forms the inner face of the band at at least some of the regions of the band for accommodating ports and/or switches of the mobile device.

4. The case according to claim 1, wherein the dissipation material has a Shore Durometer hardness of 60D to 100D.

5. The case according to claim 1, wherein the dissipation material has inwardly projecting ribs.

6. The case according to claim 5, wherein the dissipation material has outwardly projecting ribs, and there are more outwardly projecting ribs than inwardly projecting ribs.

7. The case according to claim 1, wherein the damping material has inwardly projecting ribs.

8. The case according to claim 1, wherein the damping material extends along a substantial portion of the circumference of the band including any corners.

9. The case according to claim 1, wherein the damping material is present in a number of discreet portions.

10. The case according to claim 1, wherein the flexible polymer and dissipation material are each a single continuous piece.

11. The case according to claim 1, wherein the damping material has a Shore Durometer hardness of 35A to 80A.

12. The case according to claim 1, wherein the case has a back and the band forms a wall extending away from the back.

13. The case according to claim 12, wherein the back is made substantially of the flexible polymer and is continuous with the outer layer.

14. The case according to claim 1, wherein the flexible polymer has a Shore Durometer from 80A to 100A.

15. The case according to claim 1, wherein the band has an upper lip for surrounding a screen of the mobile device, in which the lip being formed only of the flexible polymer.

16. The case according to claim 1, wherein the entire band is made from just the three materials forming the three layers.

17. The case according to claim 1, wherein the entire case is made from just the three materials forming the three layers.

18. The case according to claim 1, wherein there are no air gaps between the three layers.

19. The case according to claim 1, wherein the dissipation material has inwardly projecting ribs.

20. The case according to claim 1, wherein the dissipation material is thinner than at least one of the inner layer and the outer layer for a substantial portion of the circumference of the band.

21. The case according to claim 1, wherein the dissipation material is thinner than both of the inner layer and the outer layer for a substantial portion of the circumference of the band.

* * * * *